US011146882B2

(12) United States Patent
Guo et al.

(10) Patent No.: US 11,146,882 B2
(45) Date of Patent: Oct. 12, 2021

(54) EARPHONE

(71) Applicant: SHENZHEN GRANDSUN ELECTRONIC CO., LTD., Guangdong (CN)

(72) Inventors: Shiwen Guo, Shenzhen (CN); Yong Zhang, Shenzhen (CN); Jihui Wang, Shenzhen (CN); Zhiqiong Wei, Shenzhen (CN)

( * ) Notice: Subject to any disclaimer, the term of this patent is extended or adjusted under 35 U.S.C. 154(b) by 187 days.

(21) Appl. No.: 16/347,555

(22) PCT Filed: Mar. 24, 2017

(86) PCT No.: PCT/CN2017/078179
§ 371 (c)(1),
(2) Date: May 3, 2019

(87) PCT Pub. No.: WO2018/086296
PCT Pub. Date: May 17, 2018

(65) Prior Publication Data

US 2019/0261081 A1 Aug. 22, 2019

(30) Foreign Application Priority Data

Nov. 10, 2016 (CN) ..... 201610991844.6

(51) Int. Cl.
*H04R 1/00* (2006.01)
*H04R 1/10* (2006.01)
*H04R 5/033* (2006.01)

(52) U.S. Cl.
CPC ..... *H04R 1/1033* (2013.01); *H04R 1/1016* (2013.01); *H04R 1/1025* (2013.01); *H04R 5/033* (2013.01); *H04R 2201/10* (2013.01)

(58) Field of Classification Search
CPC .. H04R 1/1016; H04R 1/1025; H04R 1/1033; H04R 5/033; H04R 2201/10; H04R 2420/09
See application file for complete search history.

(56) References Cited

U.S. PATENT DOCUMENTS

2015/0229161 A1* 8/2015 Talmola ..... H02J 7/0072 307/23

FOREIGN PATENT DOCUMENTS

CN 204836506 12/2015
CN 204968062 U 1/2016
(Continued)

OTHER PUBLICATIONS

First Chinese Office Action for Chinese Application No. 201610991844.6 dated May 5, 2019, 5 pages.
(Continued)

*Primary Examiner* — Matthew A Eason
(74) *Attorney, Agent, or Firm* — Loza & Loza, LLP; Michael F. Fedrick

(57) ABSTRACT

An earphone including an audio play portion, a body where a printed circuit board, a plug, and a socket are installed, and a connecting wire. The plug, the socket, and the connecting wire are in electrical connection with the printed circuit board. The plug is configured to be adapted to a lightning interface integrated with an audio output and a power input, and the audio play portion and the socket are in electrical connection with the plug and capable of work simultaneously and being respectively configured to play music and charge when the plug is inserted into the lightning interface. The earphone utilizes the plug to be adapted to the lightning interface integrated with the audio output and the power input.

16 Claims, 3 Drawing Sheets

(56) References Cited

FOREIGN PATENT DOCUMENTS

| | | | | |
|---|---|---|---|---|
| CN | 204968086 | U | | 1/2016 |
| CN | 205406921 | U | | 7/2016 |
| CN | 105848028 | A | | 8/2016 |
| CN | 105868141 | A | | 8/2016 |
| CN | 205610240 | | | 9/2016 |
| CN | 106025742 | | | 10/2016 |
| CN | 205646265 | U | * | 10/2016 |
| CN | 205666933 | U | | 10/2016 |
| CN | 206272804 | | | 6/2017 |
| EP | 2905859 | A1 | | 8/2015 |
| JP | 2015507243 | A | | 3/2015 |

OTHER PUBLICATIONS

Suovanen, Jeff, "Inside Apple's New Audio Adapter", Oct. 5, 2016, retrieved from the internet, https://jp.ifixit.com/News/8448/apple-audio-adapter-teardown, 9 pgs.

* cited by examiner

EARPHONE

CROSS-REFERENCE TO RELATED APPLICATIONS

This application is the U.S. National Stage of International Patent Application No. PCT/CN2017/078179 filed on Mar. 24, 2017, which claims the benefit of priority under 35 U.S.C. § 119 to Chinese Patent Application No. 201610991844.6 filed on Nov. 10, 2016. The aforementioned applications are hereby incorporated by reference in their entireties.

TECHNICAL FIELD

The present application relates to the technical field of earphone, and more particularly to an earphone.

BACKGROUND

On mobile phones iPhone 7 and iPhone 7 Plus developed by Apple Company, an earphone insertion hole is deleted for the first time, and replaced by a lightning interface integrated with an audio output and a power input. The lightning interface can not only be utilized as a charging and data transmission interface, but also can output a digital signal and be adapted to an earphone possessing a codec chip so as to convert the digital signal into an analog sound to be sent out.

Although such kind of setting reduces the number of interfaces of the mobile phone, only one function can be used at the same time, and the user is not enabled to charge the mobile phone and listen to the music using the earphone at the same time, thereby resulting in great inconvenience.

SUMMARY

It is an object of the present application to provide an earphone, which aims at solving the problem that the user, when using an electronic device possessing a lightning interface integrated with an audio output and a power input, cannot charge the electronic device and listen to the music using the earphone at the same time.

The present application is achieved as follows: an earphone, comprises: an audio play portion, a body with a printed circuit board, a plug, and a socket mounted thereto, and a connecting wire in connection between the body and the audio play portion. The plug, the socket, and the connecting wire are configured to be in electrical connection with the printed circuit board. The plug is configured to be adapted to a lightning interface integrated with an audio output and a power input. The lightning interface is arranged on an electronic device. The audio play portion and the socket are both configured to be in electrical connection with plug and are both operable and being configured to play music and to charge respectively when the plug is inserted into the lightning interface.

Further, the body has a first insertion portion, the first insertion portion is provided with the plug, and the socket and the first insertion portion are arranged in opposite directions.

Further, sockets are stacked at the body near the connecting wire.

Further, the body further has a second insertion portion perpendicular to the first insertion portion, and the socket is arranged at the second insertion portion.

Further, the printed circuit board has a decoder chip configured to convert a digital signal and an analog signal; and the audio play portion is in electrical connection with the decoder chip via the connecting wire.

Further, the earphone further comprises a microphone. The decoder chip comprises: an analog to digital conversion module, and a digital to analog conversion module. The digital to analog conversion module is configured to convert an audio signal output from the lightning interface into an audio signal adaptable to the audio play portion, and the analog to digital conversion module is configured to convert the analog signal from the microphone into the digital signal adaptable to the lightning interface.

Further, the printed circuit board is provided with a micro control unit configured to control a state of the decoder chip.

Further, the printed circuit board is provided with a main control module configured to convert an input signal inputting from the lightning interface into a standard signal. The digital to analog conversion module is configured to convert the standard signal, which is converted from a digital audio signal input from the electronic device, into the analog signal adaptable to the earphone. The analog to digital conversion module is configured to convert the analog signal derived from the microphone of the earphone into a digital signal adaptable to the electronic device.

Further, the printed circuit board is provided with a power supply chip configured to obtain license authentication, the power supply chip is in electrical connection with the main control module, and the socket is in electrical connection with the power supply chip.

Further, the plug further comprises a connecting segment arranged at the body and in electrical connection with the printed circuit board, and the power supply chip is in electrical connection with the connecting segment.

Further, two opposite sides of the connecting segment are respectively provided with metal solder joints configured to be in electrical connection with the socket and the connecting wire. The solder joints in electrical connection with the connecting wire are LAM PWR, LAM D+, LAM D−, LAM DW, and LAM GND. The solder points in electrical connection with the socket are DP, D+, D−, and GND.

Further, the lightning interface is a lightning interface of an iPhone 7 or an iPhone 7 Plus.

The present application further provides an earphone, which comprises: an audio play portion, a printed circuit board, and a plug and a socket in electrical connection with the printed circuit board. The audio play portion is in electrical connection with the printed circuit board via a connecting wire. The plug is configured to be adapted to a lightning interface integrated with an audio output and a power input. Both the audio play portion and the socket are both operable and being configured to play music and to charge respectively when the plug is inserted into the lightning interface.

Further, the plug and the socket are installed at the printed circuit board.

Further, the plug or the socket is installed at the printed circuit board.

Further, the socket is arranged at the connecting wire.

Further, the plug or the socket is in electrical connection with the printed circuit board via a conductive wire.

Further, the earphone further comprises a sound controller configured to control audio play parameters of the audio play portion. The socket is arranged at the sound controller.

Further, the printed circuit board has a decoder chip configured to convert a digital signal and an analog signal.

The audio play portion is in electrical connection with the decoder chip via the connecting wire.

Further, the earphone further comprises a microphone. The decoder chip comprises: an analog to digital conversion module, and a digital to analog conversion module; the digital to analog conversion module is configured to convert an audio signal output from the lightning interface into an audio signal adaptable to the audio play portion, and the analog to digital conversion module is configured to convert the analog signal from the microphone into the digital signal adaptable to the lightning interface.

Further, the printed circuit board is provided with a micro control unit configured to control a state of the decoder chip.

Further, the printed circuit board is provided with a main control module configured to convert an input signal inputting from the lightning interface into a standard signal. The digital to analog conversion module is configured to convert the standard signal, which is converted from a digital audio signal input from an electronic device, into the analog signal adaptable to the earphone. The analog to digital conversion module is configured to convert the analog signal derived from the microphone of the earphone into a digital signal adaptable to the electronic device.

Further, the printed circuit board is provided with a power supply chip configured to obtain license authentication, the power supply chip is in electrical connection with the main control module, and the socket is in electrical connection with the power supply chip.

Further, the plug further comprises a connecting segment in electrical connection with the printed circuit board, and the power supply chip is in electrical connection with the connecting segment.

Further, two opposite sides of the connecting segment are respectively provided with metal solder joints configured to be in electrical connection with the socket and the connecting wire. The solder joints in electrical connection with the connecting wire are LAM PWR, LAM D+, LAM D−, LAM DW, and LAM GND. The solder points in electrical connection with the socket are DP, D+, D−, and GND.

Further, the lightning interface is a lightning interface of an iPhone 7 or an iPhone 7 Plus.

The present application have the following technical effects in comparison with the prior art: the earphone provided by the present application utilizes the plug 15 to be adapted to the lightning interface 22 integrated with the audio output and the power input. By providing the body 12 with the socket 16 and the audio play portion 30 in connection with the body 12, which can be work simultaneously, the socket 16 and the audio play portion 30 are respectively configured for audio transmission and charging, so as to realize the music listening and charging at the same time.

DESCRIPTION OF THE DRAWINGS

In order to more clearly illustrate the technical solutions in the embodiments of the present application, the drawings used in the embodiments or the prior art description will be briefly described hereinbelow. Obviously, the drawings in the following description are only some embodiments of the present application. Other drawings may be obtained from those having ordinary skill in the art without departing from the scope of the present application.

Figure 1:
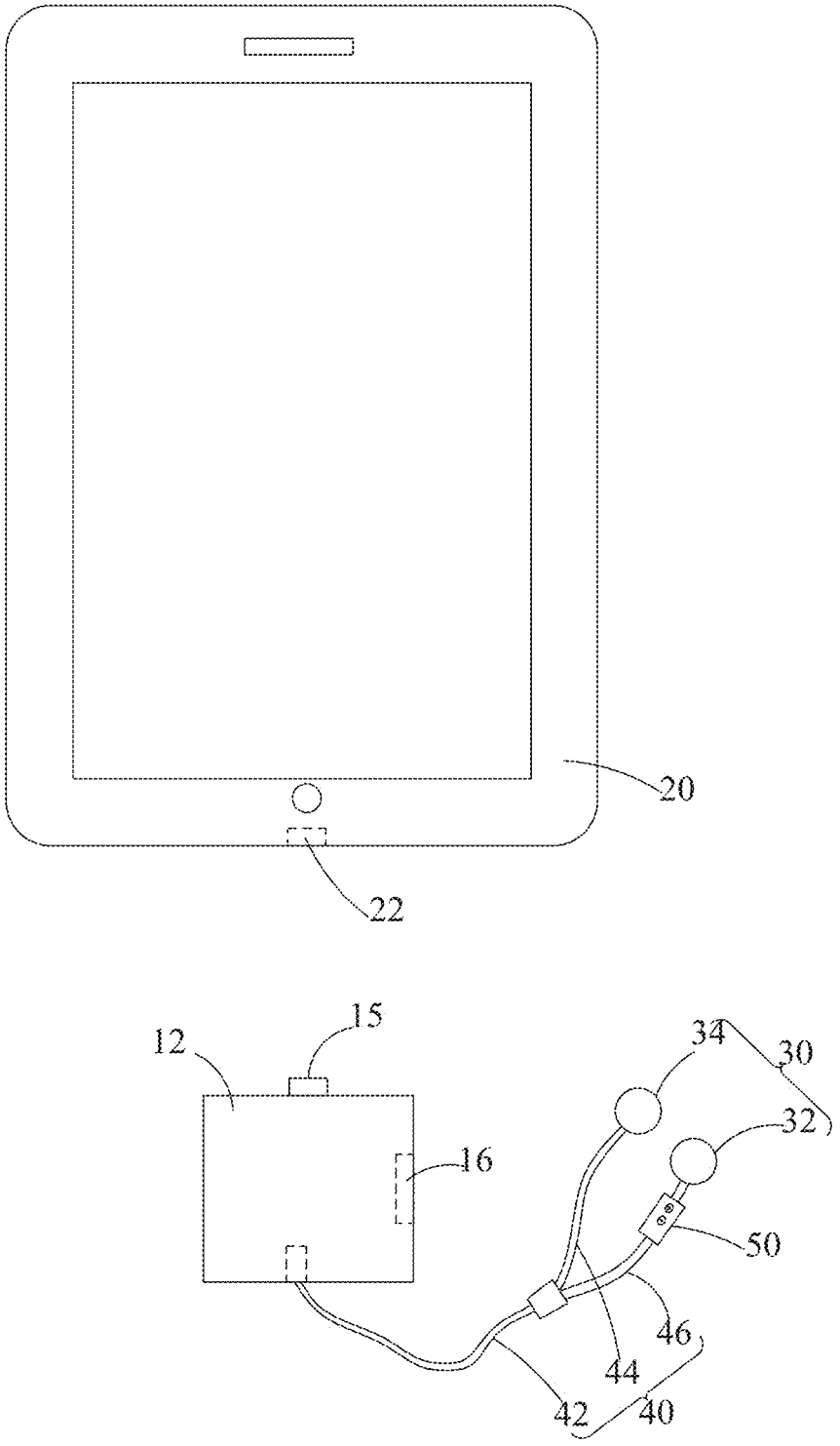
FIG. 1 is a structural schematic view of an earphone and an electronic device adapted to each other according to an embodiment of the present application.

In the drawings, reference numerals are as follows:

| | | | |
|---|---|---|---|
| 30 | Audio play portion | 12 | Body |
| 32 | Left audio play unit | 14 | Printed circuit board |
| 34 | Right audio play unit | 15 | Plug |
| 40 | Connecting wire | 16 | Socket |
| 42 | Lead segment | 11 | Decoder chip |
| 44 | Left connecting wire | 13 | Micro control unit |
| 46 | Right connecting wire | 17 | Power supply chip |
| 50 | Sound controller | 19 | Main control module |
| 20 | Device | 22 | Lightning interface |

DETAILED DESCRIPTION OF THE EMBODIMENTS

Embodiments of the present application are described in detail hereinbelow, and the examples of the embodiments are illustrated in the drawings, in which, the same or similar reference numerals are used to refer to the same or similar elements or elements having the same or similar functions. The embodiments described hereinbelow with reference to the accompanying drawings are intended to explain the application rather than to limit the present application.

It should be understood that terms "length", "width", "upper", "lower", "front", "rear", "left", "right", "vertical", "horizontal", "top", "bottom", "inside", "outside" and the like indicating orientation or positional relationship are based on the orientation or the positional relationship shown in the drawings, and are merely for facilitating and simplifying the description of the present application, rather than indicating or implying that a device or component must have a particular orientation, or be configured or operated in a particular orientation, and thus should not be construed as limiting the application.

Moreover, the terms "first" and "second" are adopted for descriptive purposes only and are not to be construed as indicating or implying a relative importance or implicitly indicating the number of technical features indicated. Thus, features prefixed by "first" and "second" will explicitly or implicitly represent that one or more of the referred technical features are included. In the description of the present application, the meaning of "a plurality of" or "multiple" is two or more unless otherwise specifically defined.

In the present application, unless otherwise specifically stipulated and defined, terms like "install", "connect", "couple", "fix" should be construed broadly, for example, they may indicate a fixed connection, a detachable connection, or an integral as a whole; may be a mechanical connection, or an electrical connection; may be in direct connection, or indirect connection via an intermediate, and may also reflect internal communication of two elements or interactions between two elements. For those skilled in the art, the specific meanings of the above terms in the present application can be understood according to specific conditions.

In order to make the purposes, technical solutions, and advantages of the present application clearer and more understandable, the present application will be further described in detail hereinafter with reference to the accompanying drawings and embodiments.

Figure 2:
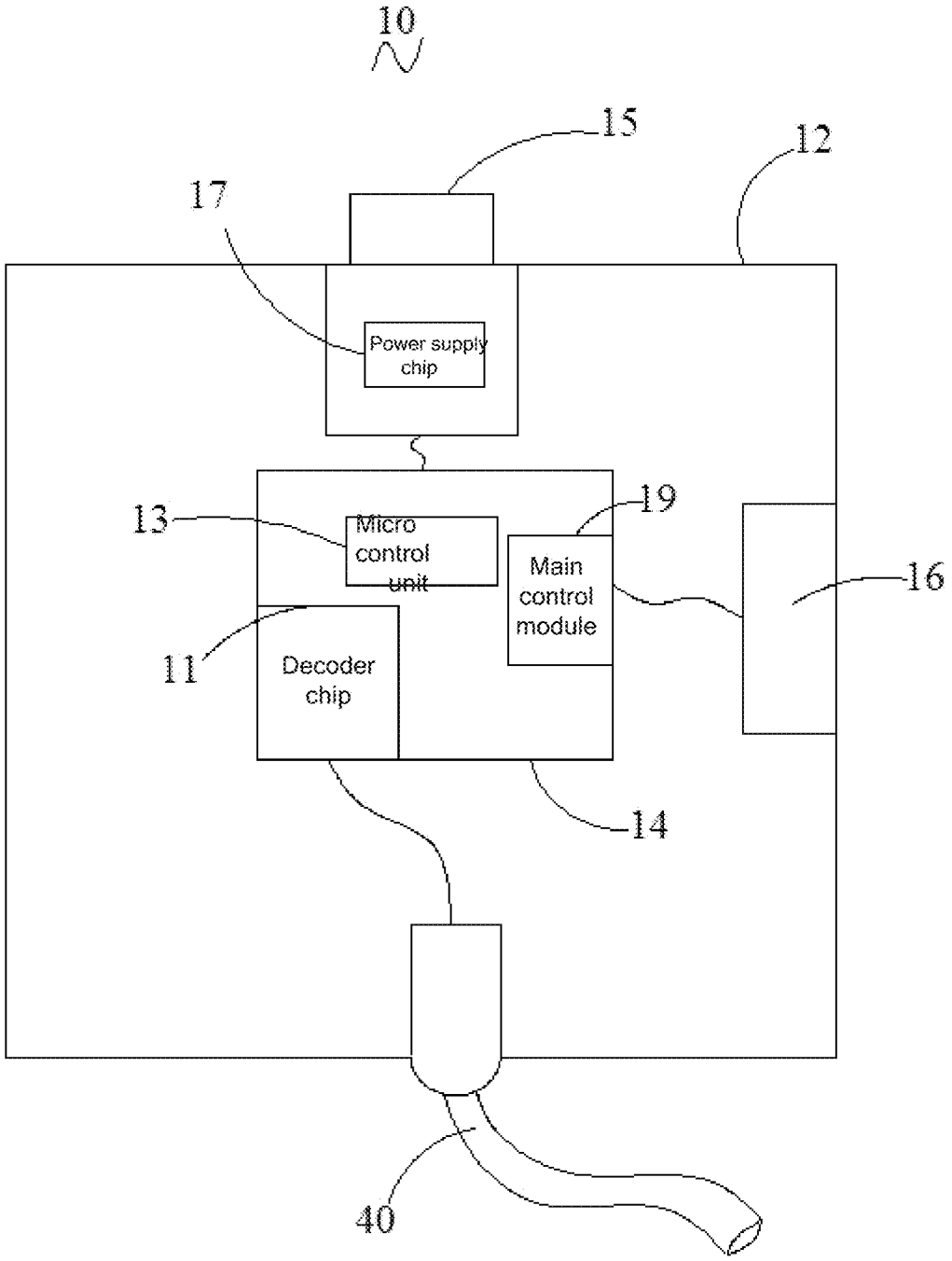
FIG. 2 is a structural schematic view of an earphone of FIG. 1.

Referring to FIGS. 1-2, an earphone provided by the present application comprises: an audio play portion 30, a printed circuit board 14, and a plug 15 and a socket 16 in electrical connection with the printed circuit board 1. The audio play portion 30 is in electrical connection with the printed circuit board 14 via a connecting wire 40. The plug 15 is configured to be adapted to a lightning interface 22 integrated with an audio output and a power input. In this way, when the plug 15 is inserted into the lightning interface 22, the socket 16 and the audio play portion 30 are capable of work at the same time for respectively playing music and charging.

The earphone provided by the present application utilizes the plug 15 to be adapted to the lightning interface 22 integrated with the audio output and the power input. By providing the body 12 with the socket 16 and the audio play portion 30 in connection with the body 12, the socket 16 and the audio play portion 30 which can work at the same time are respectively configured for audio transmission and charging, so as to realize the music listening and charging at the same time.

In an embodiment of the present application, the earphone comprises a body 12 where the printed circuit board 14, the plug 15, and the socket 16 are fixed. The connecting wire 40 is connected between the body 12 and the audio play portion 30. When the plug 15 is inserted into the lightning interface 22, by providing the body 12 with the socket 16 and the audio play portion 30 in connection with the body 12, which can work at the same time, the socket 16 and the audio play portion 30 are utilized for audio transmission and charging, so as to realize the music listening and charging at the same time.

In fact, the socket 16 may be arranged at any position of the connecting wire 40. The printed circuit board 14 may be arranged either together with the plug 15 or the socket 16.

In this embodiment, the plug 15 is a connector adapted to the lightning interface 22 integrated with the audio output and the power input. The connecting wire 40 is directly connected to the printed circuit board 14 within the body 12. In other embodiment, an insertion hole and a connector which are configured to form insertion connection may be arranged between the connecting wire 40 and the body 12, that is, the body 12 defines therein the insertion hole, and an end of the connecting wire 40 is provided with the connector. In such condition, the connector is configured as an earphone interface for being in insertion connection with a music player, for example, a universal standard 3.5 mm interface or other non-universal standard interfaces, such as a 2.5 mm interface or a 6.5 mm interface, or the lightning interface, a USB interface, a micro USB interface, a TYPE-C interface, etc. The socket 16 is a socket adapted to a charging interface, for example, a TYPE-C interface, a USB interface, a micro USB interface, a lightning interface, and other kinds of charging interfaces. Connection between the socket 16 and the electronic device which is connected with an external power supply device is utilized to realize the charging.

Referring to FIGS. 1-2, further, the body 12 has a first insertion portion (not shown in the figures), the first insertion portion is provided with the plug 15, and the connecting wire 40 extends in a direction opposite to the connecting wire 40. It can be understood that the first insertion portion and the connecting wire 40 are respectively arranged at two opposite sides of the body 12 for facilitating the insertion connection and ensuring the overall consistence of the product.

Referring to FIG. 2, further, the printed circuit board 14 has a decoder chip 11 configured to convert a digital signal and an analog signal. The decoder chip 11 is a multimedia digital signal codec, which is in charge of both digital to analog signal conversion (DAC) and analog to digital signal conversion (ADC). Preferably, the decoder chip 11 may be a codec chip, and may also be other chips capable of converting the digital signal and the analog signal.

Referring to FIGS. 1-2, further, the decoder chip 11 comprises: an analog to digital conversion module, and a digital to analog conversion module. The analog to digital conversion module and the digital to analog conversion module may be configured to convert an audio signal output by the lightning interface 22 into an audio signal adapted to the audio play portion 30, thereby realizing the music play.

Referring to FIGS. 1-2, further, the printed circuit board 14 is provided thereon with a micro control unit 13 configured to control a state of the decoder chip 11. The micro control unit 13 is configured to achieve control of a decoding state of the decoder chip 11, thereby ensuring the stability of the decoding. Specifically, when the plug 15 is inserted into the lightning interface 22, it is detected by the micro control unit 13 whether the audio signal is output. When the audio signal is detected, the decoder chip 11 is controlled to perform digital to analog conversion on the audio signal output from the lightning interface 22, thereby achieving the music listening. When it is detected by the micro control unit 13 that an analog audio signal is input, the decoder chip 11 is controlled to perform analog to digital conversion on the audio signal input from the earphone, thereby achieving earphone talking.

Referring to FIGS. 1-2, further, the printed circuit board is provided with a power supply chip 17 configured to obtain license authentication. It can be understood that in order to be adapted to related products of the Apple Company, the power supply chip 17 is required to obtain the product authentication of the Apple Company to enable mutual authentication with the Apple mobile phone used.

Referring to FIGS. 1-2, further, the printed circuit board 14 is provide thereon with a main control module 19 which is configured to convert an input signal inputting from the lightning interface 22 into a standard signal. It may be understood that the main control module is a lightning audio module, short for LAM. The main control module 19 is configured to convert the input signal inputting from the lightning interface 22 into the standard signal and transmit the standard signal to the analog to digital conversion module/the digital to analog conversion module, such that the digital to analog conversion module converts the standard signal, which is converted from the digital audio signal input from an Apple mobile phone, into an analog signal adaptable to the earphone, and the analog to digital conversion module converts an analog signal derived from an microphone of the earphone into a digital signal adaptable to an Apple mobile phone, and transmits the digital signal to the Apple mobile phone via the plug 15, in which, the switching of the functional states between the analog to digital conversion module and the digital to analog conversion module is controlled by the micro control unit 13 (i.e., the MCU chip).

For the needs of the software update, an application (short for APP, the same below) may be developed and stored in an electronic device, for example, an Apple mobile phone. When the plug 15 of the earphone is adapted to the lightning interface 22 of the electronic device, the APP is opened on the electronic device. A software update signal is transmitted to the main control module 19 via the lightning interface 22, the main control module 19 is in communication with the micro control unit 13 via a UR interface, and the software update is controlled by the micro control unit 13.

Referring to FIG. 2, in this embodiment, the power supply chip 17 is in electrical connection with the main control module 19. The socket 16 is in electrical connection with the power supply chip 17, and the audio play portion 30 is in electrical connection with the decoder chip 11 via the connecting wire 40.

Figure 3:
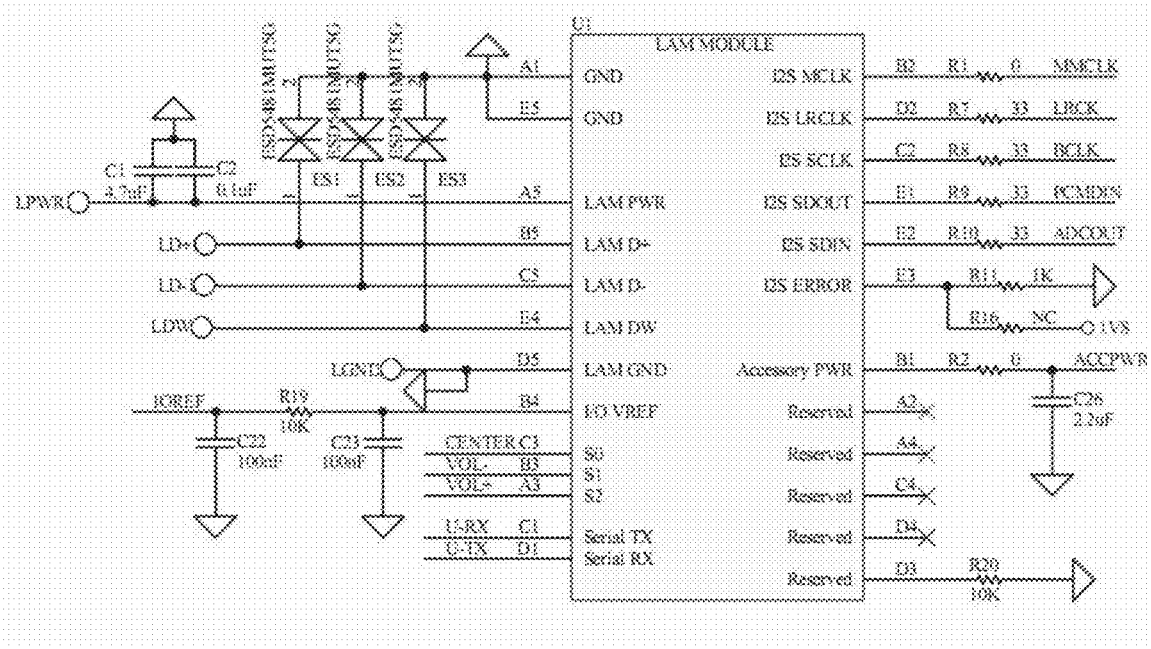
FIG. 3 is a circuit configuration diagram of solder joints configured for music listening in an embodiment of the present application.
Figure 4:
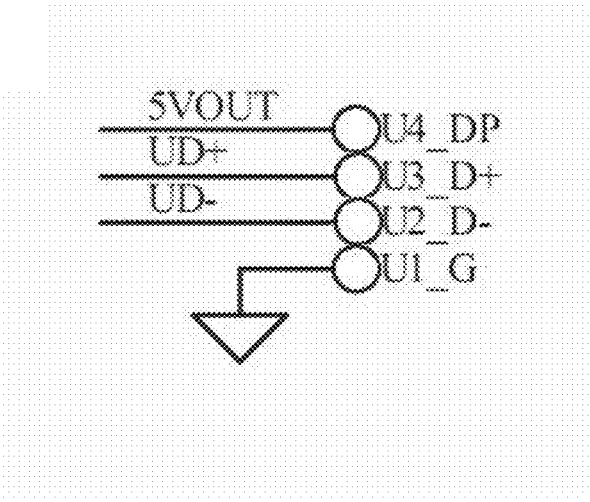
FIG. 4 is a circuit configuration diagram of solder joints configured for charging in an embodiment of the present application.

It should be noted that the plug 15 comprises an insertion portion adapted to the lightning interface 22 and a connecting segment arranged at the body 12 and in electrical connection with the printed circuit board 14. The power supply chip 17 is arranged at the connecting segment, and two opposite sides of the connecting segment are respectively provided with metal solder joints configured to connect with the socket 16 and the connecting wire 40, in which, the solder points connected to the connecting wire 40 (i.e., audio interface) are five in number and include LAM PWR, LAM D+, LAM D−, LAM DW, and LAM GND, as shown in FIG. 3; the solder points connected to the socket 16 (i.e., the charging interface) are four in number and include DP, D+, D−, and GND, as shown in FIG. 4.

Referring to FIG. 2, further, the audio play portion 30 of the earphone has a left audio play unit 32 and a right audio play unit 34. The earphone further comprises a sound controller 50 arranged between the audio play portion 30 and the body 12 and in electrical connection with the connecting wire 40. In the earphone, by setting the sound controller 50 between the audio play portion 30 and the body 12, the sound controller 50 controls audio play parameters of the audio play portion 30, for example, controlling volumes of the left audio play unit 32 and the right audio play unit 34, and switching between the music listening and the earphone talking, thereby being convenient in use.

Referring to FIG. 2, further, the connecting wire 40 comprises a lead segment 42 extended out from the body 12, a left connecting wire 44 and a right connecting wire 46 bifurcated from an end of the lead segment 42 and respectively in electrical connection with the left audio play unit 32 and the right audio play unit 34. The sound controller 50 is arranged at either the left connecting wire 44 or the right connecting wire 46, in the figures, the sound controller 50 is arranged at the right connecting wire 46. The earphone provided by the present embodiment has the connecting wire 40 set into a structure of a bifurcated two segments, which is convenient for the use by users. One end of the lead segment 42 is directly connected to the circuit board or connected to the circuit board via the earphone interface of the body 12, and extends the left audio play unit 32 via the left connecting wire 44 and the right audio play unit 34 via the right connecting wire 46. Moreover, the sound controller 50 can be arranged at either the left connecting wire 44 or the right connecting wire 46 in order to achieve the volume adjustment and the switch between the music listening and the earphone talking.

In fact, the sound controller 50 can be arranged at any position of the connecting wire 40, and the socket 16 may also be arranged on the sound controller 50.

Referring to FIG. 2, further, the body 12 further has a second insertion portion (not shown in the figures) perpendicular to the first insertion portion, and the second insertion portion is provided therein with the socket 16.

It can be understood that the plug 15, the connecting wire 40, and the socket 16 are respectively arranged at three sides of the body 12. For a body 12 in a cubic structure, the plug 15 and the connecting wire 40 are arranged at two opposite sides of the body 12, and the socket 16 may be arranged at a side other than the sides the plug 15 and the connecting wire 40 arranged.

In another embodiment, the plug 15 and the socket 16 are arranged at different sides of the body 12. The plug 15 may be either directly arranged at the body 12, or in electrical connection with the printed circuit board 14 of the body 12 via a connecting wire (not shown in the figures).

Referring to FIGS. 1-2, further, the lightning interface 22 is a lightning interface of an iPhone 7 or iPhone 7 Plus. That is, the device provided with the lightning interface 22 may be an iPhone 7 or an iPhone 7 Plus, or even other devices provided with such kind of the lightning interface 22, for example, an iPod or an iPad manufactured by the Apple Company, or other mobile devices manufactured by other companies, which are not limited herein. In such condition, the plug 15 is a lighting plug configured to be adapted to the Lighting interface. The socket 16 may be a lighting interface integrated with audio output, power input, and data exchange.

In this embodiment, the number of the socket 16 may be one, two, three or even more, and the adaptable interface types may be either totally the same or different; and may be partially the same or partially different.

When the number of the socket 16 is two, the sockets 16 may be stacked together either at the body 12 approaching the connecting wire 40 or at the body 12 approaching the socket 16. It may be understood that the stacking refers to stack the sockets 16 at the body 12 in a thickness direction thereof, such that the structure of the whole body 12 is more compact.

In another embodiment, the body 12 has a third insertion portion opposite to the second insertion portion, in addition to the second insertion portion perpendicular to the first insertion portion. The third insertion portion is also perpendicular to the first insertion portion. The third insertion portion is provided with a socket. An interface type adapted to the socket may be the same as that of the socket 16, or may be different from the socket 16. In such condition, one or more of the sockets may be further stacked at the body 12 near the first insertion portion, the second insertion portion, the third insertion portion, and the connecting wire 40. These sockets can be arranged at any position in the body 12 according to ergonomics and product design requirements, which is not limited herein.

When the body 12 has a plurality of the sockets, the plurality of sockets may be interfaces of any type, such as a lightning interface, an audio interface, a data conversion interface, and the like, as long as the interfaces of different kinds are in electrical connection with the corresponding solder joints at the connecting segment of the plug 15.

In the above description, one of the functions of the plug 15, a single socket or interface, such as music listening or charging, is mainly utilized. In fact, no matter the plug 15 or the single socket or interface, they have many functions, such as music listening, charging, and data exchange. The Lighting socket that is adapted to the lighting plug, like the lighting interface of iPhone 7 or iPhone 7 Plus, combines the functions of charging, music listening, and data exchange, in this way, it is equivalent to transplant the lighting interface of the iPhone 7 or iPhone 7 Plus into the earphone.

The above is only the preferred embodiments of the present application, and is not intended to limit the application. Any modifications, equivalent substitutions, and improvements made within the spirit and principles of the present application are included in the protection scope of the present application.

What is claimed is:

1. An earphone comprising an audio play portion, a microphone, a body with a printed circuit board, a plug and a socket mounted thereto, and a connecting wire in connection between the body and the audio play portion, wherein:

the plug, the socket, and the connecting wire are configured to be in electrical connection with the printed circuit board;

the plug is configured to be adapted to a lightning interface integrated with an audio output and a power input, wherein the lightning interface is arranged on an electronic device; and the audio play portion and the socket are both configured to be in electrical connection with the plug and are both operable and configured to play music and to charge respectively when the plug is inserted into the lightning interface;

the printed circuit board has a decoder chip configured to convert a digital signal and an analog signal, and the audio play portion is in electrical connection with the decoder chip via the connecting wire; and the decoder chip comprises an analog to digital conversion module and a digital to analog conversion module, the digital to analog conversion module is configured to convert an audio signal output from the lightning interface into an audio signal adaptable to the audio play portion, and the analog to digital conversion module is configured to convert the analog signal from the microphone into the digital signal adaptable to the lightning interface.

2. The earphone of claim 1, wherein the body has a first insertion portion, the first insertion portion is provided with the plug, and the socket and the first insertion portion are arranged in opposite directions.

3. The earphone of claim 2, wherein sockets are stacked at the body near the connecting wire.

4. The earphone of claim 2, wherein the body further has a second insertion portion perpendicular to the first insertion portion, and the socket is arranged at the second insertion portion.

5. The earphone of claim 1, wherein the printed circuit board is provided with a micro control unit configured to control a state of the decoder chip.

6. The earphone of claim 5, wherein the printed circuit board is provided with a main control module configured to convert an input signal inputting from the lightning interface into a standard signal; the digital to analog conversion module is configured to convert the standard signal, which is converted from a digital audio signal input from the electronic device, into the analog signal adaptable to the earphone; and the analog to digital conversion module is configured to convert the analog signal derived from the microphone of the earphone into a digital signal adaptable to the electronic device.

7. The earphone of claim 1, wherein the printed circuit board is provided with a power supply chip configured to obtain license authentication, the power supply chip is in electrical connection with the main control module, and the socket is in electrical connection with the power supply chip.

8. The earphone of claim 7, wherein the plug further comprises a connecting segment arranged at the body and in electrical connection with the printed circuit board, and the power supply chip is in electrical connection with the connecting segment.

9. The earphone of claim 8, wherein two opposite sides of the connecting segment are respectively provided with metal solder joints configured to be in electrical connection with the socket and the connecting wire.

10. The earphone of claim 1, wherein the lightning interface is a lightning interface of a mobile phone.

11. An earphone comprising an audio play portion, a microphone, a printed circuit board, and a plug and a socket in electrical connection with the printed circuit board, wherein:

the audio play portion is in electrical connection with the printed circuit board via a connecting wire; the plug is configured to be adapted to a lightning interface integrated with an audio output and a power input; and both the audio play portion and the socket are operable and configured to play music and to charge respectively when the plug is inserted into the lightning interface;

the printed circuit board has a decoder chip configured to convert a digital signal and an analog signal; and the audio play portion is in electrical connection with the decoder chip via the connecting wire; and the decoder chip comprises an analog to digital conversion module and a digital to analog conversion module; the digital to analog conversion module is configured to convert an audio signal output from the lightning interface into an audio signal adaptable to the audio play portion;

and the analog to digital conversion module is configured to convert the analog signal from the microphone into the digital signal adaptable to the lightning interface.

12. The earphone of claim 11, wherein the plug and the socket are installed at the printed circuit board.

13. The earphone of claim 11, wherein the plug or the socket is installed at the printed circuit board.

14. The earphone of claim 11, wherein the socket is arranged at the connecting wire.

15. The earphone of claim 11, wherein the plug or the socket is in electrical connection with the printed circuit board via a conductive wire.

16. The earphone of claim 11, further comprising a sound controller configured to control audio play parameters of the audio play portion, wherein the socket is arranged at the sound controller.

* * * * *